US008091817B2

(12) United States Patent
Fried

(10) Patent No.: US 8,091,817 B2
(45) Date of Patent: Jan. 10, 2012

(54) MILLING DEVICE

(75) Inventor: Andrew Charles Fried, Slatington, PA (US)

(73) Assignee: FLSmidth A/S (DK)

( * ) Notice: Subject to any disclaimer, the term of this patent is extended or adjusted under 35 U.S.C. 154(b) by 144 days.

(21) Appl. No.: 12/635,978

(22) Filed: Dec. 11, 2009

(65) Prior Publication Data

US 2011/0139913 A1 Jun. 16, 2011

(51) Int. Cl.
*B02C 15/10* (2006.01)
*B02C 17/08* (2006.01)

(52) U.S. Cl. ..... 241/201; 241/202

(58) Field of Classification Search ..... 241/201, 241/202

See application file for complete search history.

(56) References Cited

U.S. PATENT DOCUMENTS

| | | | | |
|---|---|---|---|---|
| 1,585,755 | A | 5/1926 | Borcherdt | |
| 2,115,314 | A | 4/1938 | McErlean | |
| 3,269,668 | A | 8/1966 | Hall | |
| 3,337,142 | A | 8/1967 | Williams | |
| 3,497,321 | A | 2/1970 | Decker et al. | |
| 3,529,781 | A | 9/1970 | Hastrup | |
| 3,566,638 | A | 3/1971 | Herbst | |
| 3,770,214 | A | 11/1973 | Gabor et al. | |
| 3,840,191 | A * | 10/1974 | Herzog | 241/199.1 |
| 3,904,130 | A | 9/1975 | Delfosse et al. | |
| 3,933,316 | A | 1/1976 | Jones | |
| 3,955,766 | A | 5/1976 | Chang | |
| 3,987,969 | A | 10/1976 | Mortenson | |
| 4,113,189 | A | 9/1978 | Sullivan | |
| 4,147,308 | A | 4/1979 | Mikkelsen | |
| 4,325,514 | A | 4/1982 | Hemingsley | |
| 4,349,158 | A | 9/1982 | Broman | |
| 4,369,926 | A | 1/1983 | Rasmussen et al. | |
| 4,382,558 | A | 5/1983 | Svensson | |
| 4,485,974 | A | 12/1984 | Lass | |
| 4,491,280 | A | 1/1985 | Bacharach et al. | |
| 4,504,019 | A * | 3/1985 | Newell et al. | 241/73 |
| 4,512,525 | A * | 4/1985 | Cameron | 241/207 |
| 4,582,260 | A | 4/1986 | Folsberg | |
| 4,629,135 | A * | 12/1986 | Bodine | 241/201 |
| 4,697,747 | A | 10/1987 | Trelby | |
| 4,886,216 | A * | 12/1989 | Goble | 241/152.1 |
| 4,934,613 | A | 6/1990 | Kukuch | |
| 5,100,068 | A | 3/1992 | Pingel | |

(Continued)

FOREIGN PATENT DOCUMENTS

SE 303082 B 8/1968

*Primary Examiner* — Bena Miller

(74) *Attorney, Agent, or Firm* — Daniel DeJoseph; Aaron M. Pite; Jeffrey A. Sharp

(57) ABSTRACT

A milling device includes a grinding member, a table, a plurality of actuators and a controller. The table has a grinding surface. The table is positioned adjacent to the grinding member such that the grinding surface faces toward at least a portion of the grinding member. The table and the grinding member at least partially define a grinding chamber sized and configured to receive material. Each actuator is connected to the grinding member such that movement of that actuator causes at least a portion of the grinding member to move from a raised position to a lowered position to grind the material. The controller is connected to the actuators and is configured to cause the actuators to move in a sequence that causes the grinding member to wobble as the grinding member is moved by the actuators to grind material.

25 Claims, 10 Drawing Sheets

U.S. PATENT DOCUMENTS 5,242,123 A * 9/1993 Parham ..... 241/37.5
5,355,707 A 10/1994 Inoue et al.
5,361,996 A 11/1994 Svensson et al.
5,373,635 A 12/1994 Nonaka et al.
5,405,091 A 4/1995 Folsberg
5,716,015 A 2/1998 Folsberg
5,806,772 A * 9/1998 Karra ..... 241/57
5,820,045 A * 10/1998 Karra ..... 241/207
5,951,220 A 9/1999 Katsura et al.
6,318,649 B1 11/2001 Mazurkiewicz
6,508,421 B1 1/2003 Tumilty et al.
7,028,934 B2 4/2006 Burynski, Jr. et al.
7,578,459 B2 8/2009 Viljoen
7,581,689 B2 9/2009 Schenk
2002/0011534 A1 1/2002 Konetzka et al.
2002/0139880 A1 10/2002 Heukamp
2003/0010082 A1 1/2003 Choi
2003/0019271 A1 1/2003 Yamamoto et al.
2003/0024292 A1 2/2003 Yamamoto et al.
2003/0024293 A1 2/2003 Yamamoto et al.
2005/0045756 A1 3/2005 Pizzuto

* cited by examiner

MILLING DEVICE

FIELD OF INVENTION

The present invention relates to milling devices, such as mills.

BACKGROUND OF THE INVENTION

Milling devices, such as ball mills or roller mills are typically used to grind or pulverize material to a smaller size. Typically, the mills are configured to grind material to a size within a predetermined size range. Milling devices are often used in crushing circuits for mining operations, or for crushing or grinding material for use in cement manufacturing. Examples of milling devices may be found in U.S. Pat. Nos. 1,585,755, 2,115,314, 3,269,668, 3,337,142, 3,497,3214,886,216, 4,934,613, 5,100,068, 5,355,707, 5,361,996, 5,405,091, 5,716,015, 6,318,649, 6,508,421, 7,028,934 or U.S. Patent Application Publication Nos. 2002/0011534, 2002/0139880 or 2005/0045756.

Some types of milling devices include roll presses, roller mills or ball mills. Roll presses generally compress material between two rollers. Roll presses often have a hydraulic system configured to hold the rollers together to apply the compression to the material being ground, or milled. Roll presses are typically difficult to control material grinding size and, as a result, are generally less effective at making very finely ground material compared to other milling devices.

Roller mills typically have vertical wheels that push down on a driven table, or conveyor. Hydraulic cylinders or other mechanism are often used to push the vertical wheels or rollers, down on the driven table or conveyor. Roller mills typically directly apply a combination of compression and shear forces to grind material. This direct contact results in efficient grinding. Table roller mills typically feature a gear reducer that usually has large thrust capabilities to support the table and the grinding force of the mill. A roller mill typically has its grinding force limited by the gear reducer's upward thrust capability. Moreover, the grinding forces are typically required to pass through roller bearings that transmit force through line contact. Roller mills often have complicated stands, pressure levers, lubrication systems, multistage gear reducers, and usually require relatively large bearings. The cost of roller mills is generally high relative to other mills, such as ball mills.

Ball mills typically have a cylinder full of spherical balls that rotates with raw material floating in between the balls within the cylinder. The balls are lifted by the spinning action of the cylinder and fall or cascade on one another to grind material via impact and shearing forces. Ball mills are typically simple in design. However, operation of ball mills usually uses more energy relative to other types of mills. For instance, the random nature of the ball movement sometimes results in the balls hitting each other instead of the material, which wastes energy.

A new type of mill is needed that provides for a simple mill design that can be made and sold at a relatively low cost and also efficiently utilizes energy and provides compression and shearing forces that act on material to grind that material. Preferably, such a mill would be designed to be less expensive than roller mills and more energy efficient than ball mills.

SUMMARY OF THE INVENTION

A milling device is provided. The milling device may include a grinding member, a table, a plurality of actuators and a controller. The table has a grinding surface and is positioned adjacent to the grinding member such that the grinding surface faces toward at least a portion of the grinding member. The table and the grinding member at least partially define a grinding chamber sized and configured to receive material. Each actuator is connected to the grinding member such that movement of each actuator causes at least a portion of the grinding member to move from a raised position to a lowered position to grind material that may be positioned in the grinding chamber. The controller is connected to the actuators. The controller is configured to cause the actuators to move in a sequence that causes the grinding member to wobble as the grinding member is moved by the actuators to grind the material.

Preferably, each actuator is a fluid cylinder, hydraulic cylinder, a gas cylinder, an electric linear actuator, a lever action actuator or a linear moving actuator. For example, each actuator may be configured to move from a raised position to a lowered position via a linear path or substantially linear path of movement. The actuators may be positioned so that the actuators move from a raised position to a lower position in only a vertical direction of movement. Alternatively, the actuators may be positioned so that the actuators move linearly along an angle so that their movement has both vertical and horizontal components to their movement. For instance, the actuators may be positioned at an inward lean position so that the actuators move toward the table when the actuators move from a raised position to a lower position. As another example, the actuators may be positioned at an outward lean position so that the actuators move away from the table when they move from a raised position to a lowered position.

The controller may be configured to cause the grinding member to wobble in a clockwise direction or in a counterclockwise direction. Of course, the controller could be configured to alternate between such wobbling directions as well. For example, the controller may be configured to cause the grinding member to initially wobble in a clockwise direction for a first amount of time to grind material and, thereafter, wobble in a counterclockwise direction for another amount of time to grind the material.

The grinding member may have a milling portion that defines a milling surface. The milling surface can have one or more treads or projections. The treads or projections may be configured to enhance a grinding characteristic or help control material flow through at least a portion of the grinding chamber. The grinding surface of the table may also have one or more treads or projections. Some embodiments of the milling device may include a grinding member that has a channel positioned adjacent to an output opening defined by the table and the grinding member. The channel may be sized and configured to act as an expansion gap for material being ground or may function as a dam ring.

The grinding member or the table may also at least partially define an output opening sized and configured to receive ground material. A dam ring or a ramped dam ring may be positioned adjacent to the output opening. For example, the dam ring may be integral with the table or may be attached to a portion of the table. Utilization of a dam ring may retain the material on the table to aid with fine grinding requirements.

It should be appreciated that the grinding member and table can be designed such that the grinding chamber may be defined in a number of different geometries. Preferably, the grinding chamber is sized and configured to cause material that is being ground to move in a downward direction as the material is being ground in the grinding chamber. The grinding chamber may also be sized and configured so that the material is also moved in an outward or an inward direction as the material is being ground. It is contemplated that the grinding chamber may include multiple portions. Each portion may have a different angle of inclination so that material being ground moves more slowly or more quickly through different portions of the grinding chamber than other portions.

Embodiments of the milling device may include a table that has an opening and a grinding member that has a first opening aligned with the opening of the table. These openings may be sized and configured to permit air to flow through the openings to push ground material out of the grinding chamber toward an output opening of the milling device. The grinding member may also have a second opening sized and configured to receive material and guide that material to the grinding chamber.

The milling device may also include a housing that at least partially encloses the grinding member and the table. The housing can have an output opening sized and configured to permit material that has been ground by the milling device to pass therethrough. The housing may also have a nozzle ring attached adjacent to the table or the grinding member that is configured to allow air to pass therethrough to cause material exiting the grinding chamber that is ground to a predetermined size to be pushed toward the output opening of the housing.

Embodiments of the milling device may include a grinding member that has an upper portion sized and configured to permit choke feeding of material. For example, an upper portion of the grinding member may be sized and configured to define an opening that is sized and shaped to collect material and retain the material for choke feeding.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of milling devices, and methods of making such devices are shown in the accompanying drawings in which.

DETAILED DESCRIPTION OF PRESENT PREFERRED EMBODIMENTS

Figure 1:
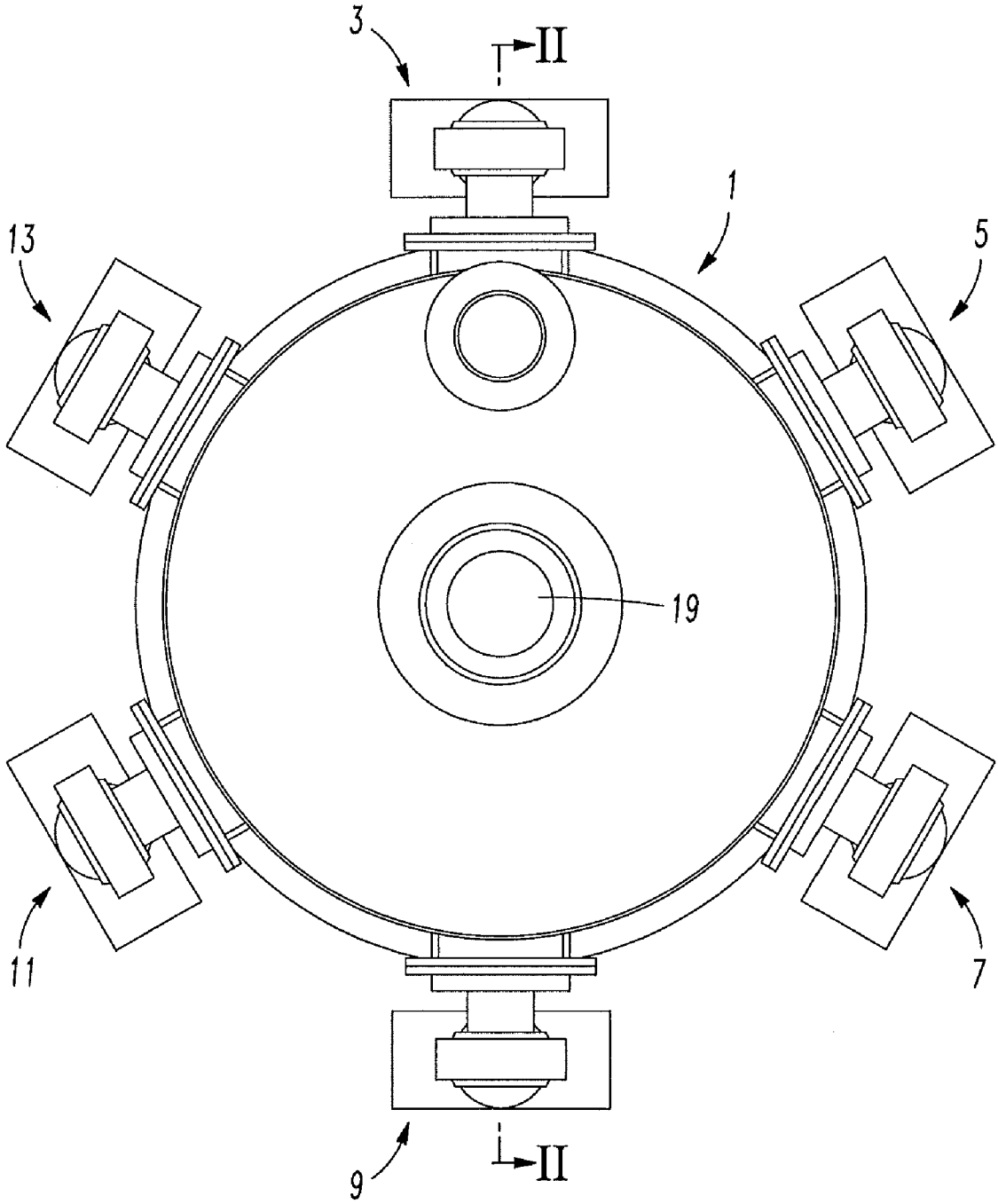
FIG. 1 is a top view of a first present preferred embodiment of a milling device.
Figure 2:
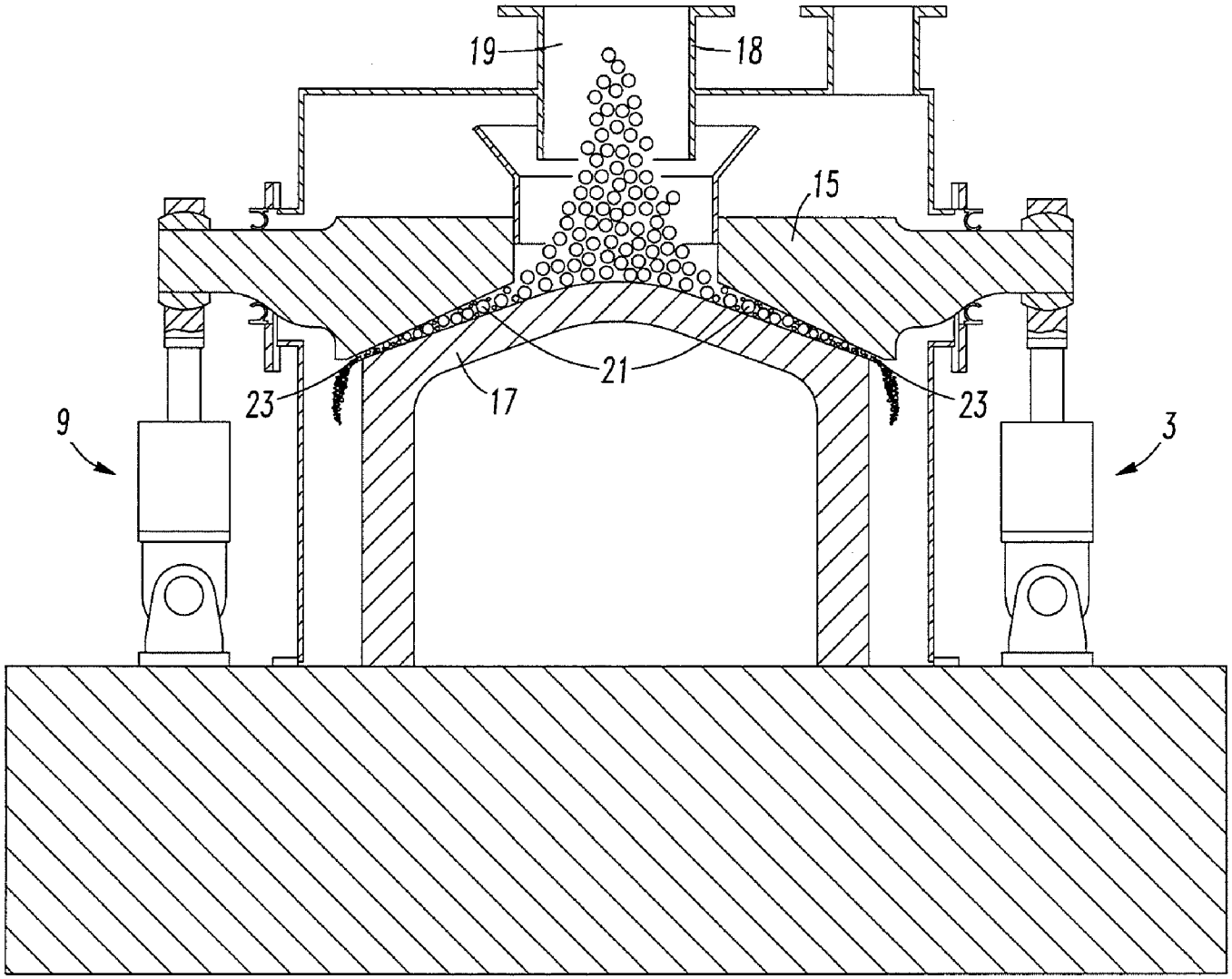
FIG. 2 is a cross sectional view of the first present preferred embodiment of the milling device taken along line II-II in FIG. 1.

A first present preferred embodiment of the milling device may be appreciated from FIGS. 1-3A. A mill 1 includes actuators 3, 5, 7, 9, 11 and 13 that are configured to raise and lower a grinding member 15 adjacent to a table 17, or an anvil. One end of each actuator may be connected to the grinding member 15 by one or more bearings. The bearings may form connections between the actuators and the grinding member or may at least partially define such connections. The other end of each actuator may be attached to the ground or a support by one or more bearings.

The grinding member 15 may be a die or a body sized and configured to move toward the grinding surface of the table to compress material to grind the material to a smaller size. The actuators may be fluid cylinders, hydraulic cylinders, gas cylinders, electric linear actuators, a lever action actuator or other actuators. Preferably, the actuators are configured for linear movement or are linear moving actuators. For example, the actuators are preferably configured to move from a raised position to a lowered position in a linear path, a substantially linear path, or along a straight-line stroke.

The actuators are attached to the grinding member 15 such that the grinding member 15 is moveable relative to the table 17. The grinding member 15 and the table 17 define a crushing chamber 21. Material positioned in the crushing chamber is milled to a smaller size when the grinding member is moved by the actuators to grind material against the surface of the table 17. After material has been ground by the mill 1 it exits the crushing chamber 21 via an output opening 23 defined along a perimeter portion of the mill. Preferably, the mill 1 is configured to grind material such as ore, limestone, coal, stone, rock, minerals or other substances.

The mill 1 is positioned in a milling circuit or crushing circuit such that material can be fed to the mill 1 via receptacle 18 formed in the mill 1. The receptacle 18 defines an opening 19 that guides material fed to the mill into the crushing chamber 21. Preferably, the mill 1 is configured to mill or crush the material until the material is pulverized to within a predetermined size range.

Preferably, the grinding member 15 and table 17 are composed of metal. For example, the grinding member may be composed of a hard material such as a chrome iron or a cast iron and the table may be composed of a typical wear metal for heavy duty crushers or heavy duty mills. Of course, it is contemplated that the grinding member and table components may be composed of other materials such as steel, stainless steel, titanium, alloys, or other metals.

The actuators 3, 5, 7, 9, 11, and 13 are connected to a controller. The controller is configured to cause the actuators to lift and lower the grinding member 15 in a sequential sequence configured to cause the grinding member to wobble as it is raised and lowered, as may be appreciated from the flow chart shown in FIG. 3A. For instance, the controller may cause actuator 3 to move from a raised position to a lowered position. At the same time, the controller may also cause actuator 9, which is opposite actuator 3, to move from a lowered position to a raised position. After actuator 3 is lowered to its lowered position, the controller may cause actuator 5 to move from its raised position to its lowered position. When actuator 5 is moved from its raised position to its lowered position, the controller may also cause actuator 11, which is opposite actuator 5, to move from its lowered position to its raised position. After actuator 5 is moved to its lowered position, the controller may cause actuator 7 to move from a raised position to its lowered position. When actuator 7 is moving to its lowered position, the controller may also cause actuator 13, which is opposite actuator 7, to move from its lowered position to its raised position. After actuator 7 is in its lowered position, the controller may cause actuator 9 to move from its raised position to its lowered position. While actuator 9 is in the process of being moved from its lowered position to its raised position, the controller may cause actuator 3 to move from its lowered position to its raised position. After actuator 9 is moved to its lowered position, the controller may cause actuator 11 to move from its raised position to its lowered position. While actuator 11 is moved to its lowered position the controller may cause actuator 5, which is opposite actuator 11, to move from its lowered position to its raised position. After actuator 11 is moved to its lowered position, the controller may cause actuator 13 to move from its raised position to its lowered position. While actuator 13 is moved to its lowered position, the controller may also cause actuator 7, which is opposite actuator 13, to move from its lowered position to its raised position.

Preferably, the controller is configured to cause the actuators of the mill 1 to repeat in such a pressuring pattern with the actuators being 60 degrees out of phase from each other, over and over in a cyclical process to produce a wobbling effect to the grinding member 15 movement. It should be understood that such wobbling movement, or orbital movement, of the grinding member 15 permits the grinding member 15 to impart both a compression force from the pressing of the grinding member against the material within the grinding chamber and also a shearing force from the orbital motion of the grinding member 15 around the table 17.

Of course, in the event that an embodiment of a milling device is designed to include more or less than size actuators, the out of phase sequential actuation of the actuators may change to meet a desired design goal. For example, an embodiment of a milling device that included eight actuators could be configured to cause the actuators to repeat a sequential lifting and lowering sequence 45 degrees out of phase. As another example, an embodiment of a milling device that included ten actuators could be configured to cause the actuators to repeat a sequential lifting and lowering sequence 36 degrees out of phase. As discussed above with reference to the mill 1 illustrated in FIGS. 1-3A, the out of phase sequential actuation of the actuators causes the die of the milling device to wobble as the die is raised and lowered to grind material.

It should be appreciated that bearings may be used to connect each actuator to the grinding member. Preferably, the bearings are configured to permit movement along 2 or three different axes. Bearings may also be used to connect the actuator to a support that supports the actuator or mounts or positions the actuator in a particular location adjacent to the grinding member and the table. It is contemplated that generally spherical or spherical bearings would work particularly well. Of course, other bearings could also be used.

It is also contemplated that a lubrication system may be provided. A lubrication system could be connected to a milling device such that lubricant could be provided to different moveable components. Such a lubrication system may be designed to provide a desired amount of lubricant or achieve a desired heat transport to an embodiment of the milling device. For example, a lubrication system could be connected to a milling device to ensure a flow of lubricant passes adjacent to or through the bearings attached to the actuators to ensure a flow of lubricant passes by the bearings such that the bearings do not overheat and are properly lubricated for the raising and lowering of the grinding member.

The controller may be configured to actuate the actuators to move them in such a circular sequence when the mill 1 is operated to grind material to a predetermined size range or is operating in a steady state condition. The controller may be configured to cause the grinding member to wobble in a clockwise direction or a counterclockwise direction. It is also contemplated that the controller could be configured to cause the grinding member to wobble in different directions. For example, the controller may be configured to cause the grinding member to wobble in a clockwise direction for a first predetermined amount of time and then switch to wobbling in a counterclockwise direction for a second predetermined amount of time. It should be understood that the controller could also be configured to cause the wobbling to alternate between counterclockwise and clockwise directions any number of times to achieve a desired design objective.

Figure 3:
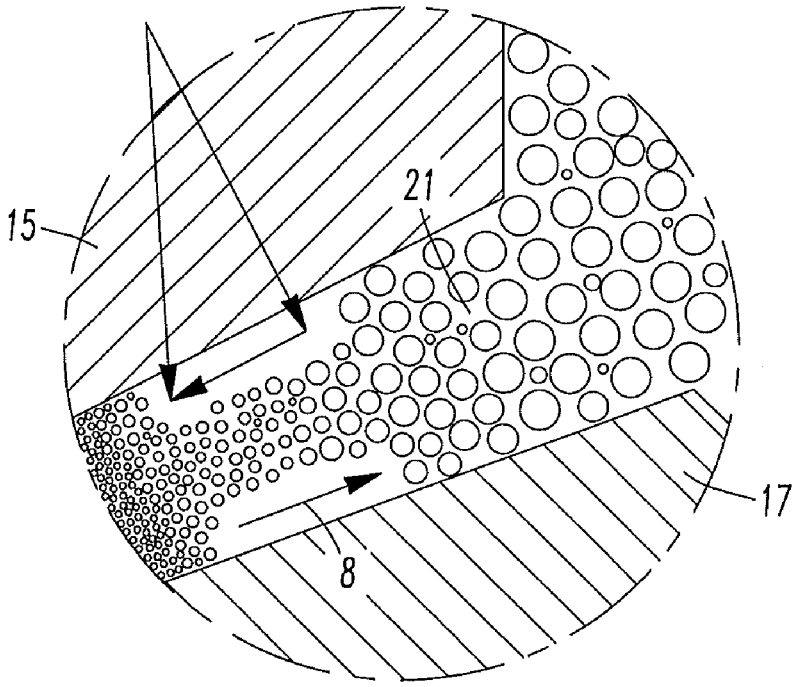
FIG. 3 is an enlarged view of a portion of the first present preferred embodiment shown in FIG. 2 illustrating the movement of material being ground by the milling device.

As may be appreciated from FIG. 3, the material fed into the receptacle passes along the grinding chamber 21 to an output opening 23 as the grinding member oscillates and is moved upwards and downwards by the actuators. As the material moves along the grinding chamber 21, the material is pulverized to a smaller size. The grinding member 15 imparts a compression force, which is illustrated by arrows 10 and, due at least in part to the wobbling motion of the grinding member 15, also imparts a shearing force which is illustrated by arrows 8 to the material being ground. The feed rate of material and the operation of the grinding member 15 is preferably designed to control the size of the material that may pass through the output opening 23 of the mill 1 to being within a predetermined size range.

Material that passes from the output opening 23 may be collected in a collection system or be passed to a classifier or a separator. Material that was not sufficiently ground may be sent back to the mill 1 for further grinding while material that was properly ground may be passed on to another portion of the grinding circuit or may be fed to some other mechanism or apparatus for further processing or for storage.

It should be understood that the shearing force applied by the grinding member 15 increases as the orbital movement, or wobbling movement, of the grinding member during milling operations increases. It is contemplated that the wobbling movement of the grinding member may also be increased or reduced due to the orientation of the actuators 3, 5, 7, 9, 11, and 13.

Figure 4:
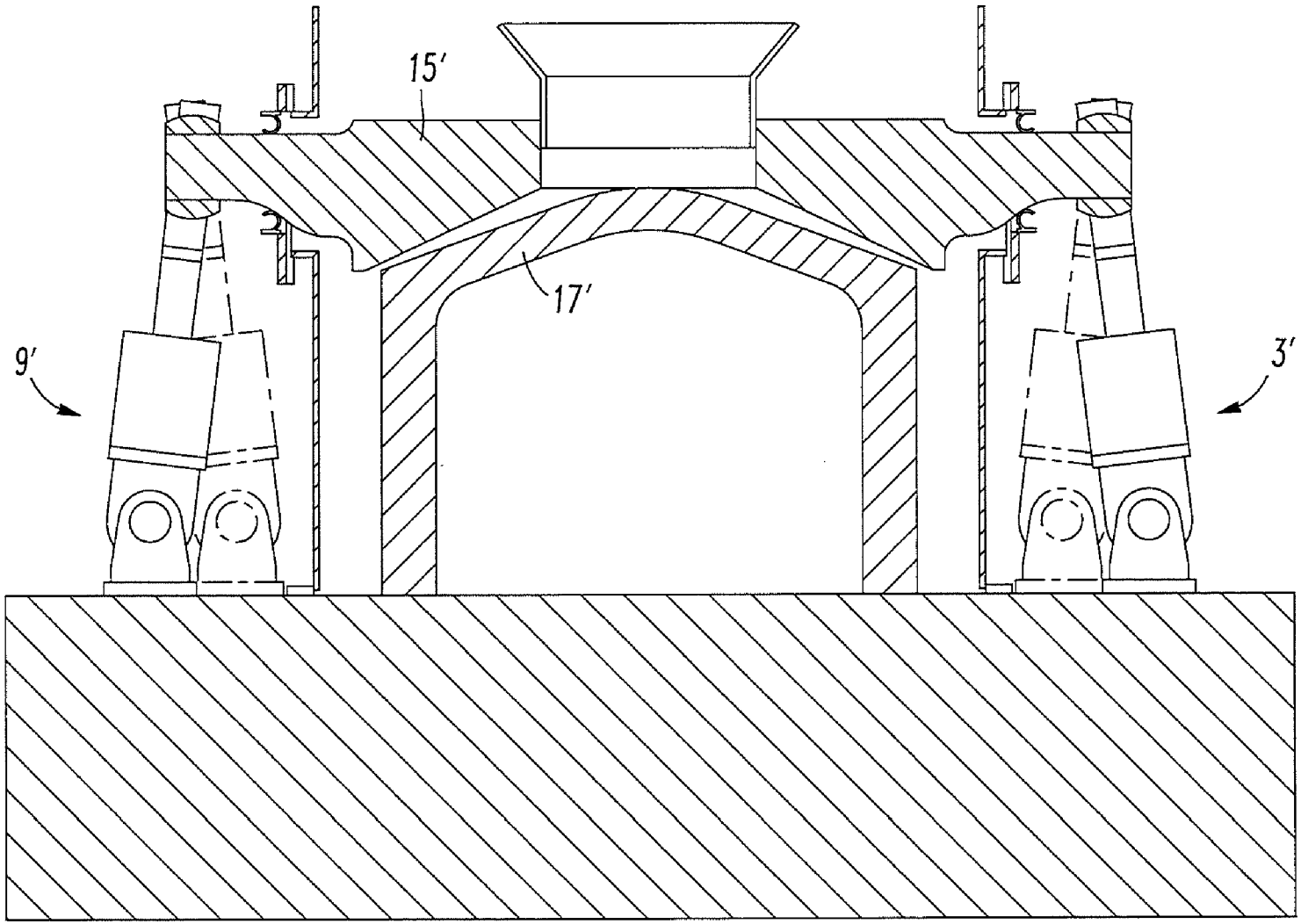
FIG. 4 is a view similar to FIG. 2 of a second present preferred embodiment of the milling device illustrating the cylinders of the milling device in an outward lean position and illustrating the cylinders in an inward lean position in chain line.

For example, actuators 3' and 9' may have a terminal end distal from the grinding member 15' positioned in an inboard lean position as shown in broken line in FIG. 4 or an outboard lean position as shown in solid line in FIG. 4. An inboard lean arrangement may help reduce the orbital movement of the grinding member 15' relative to the table 17' to reduce the shearing force applied by the grinding member 15'. When in an inward lean position, an actuator may move toward the table when the actuator is moved from a raised position to a lower position. An outboard lean arrangement may help increase or enhance the orbital movement or wobbling movement of the grinding member 15'. When an actuator is positioned in an outward lean position, the actuator is configured to move away from the table when it moves from a raised position to a lowered position.

It is also contemplated that the geometry of the mill and weight of the mill components may be adjusted to help increase or decrease the orbital movement or wobbling of the grinding member. Moreover, the geometry and weight of the mill may permit less or more actuators to be used to create a desired wobbling movement or milling operation. For instance, it is contemplated that portions of the grinding member my be cantilevered and weighed such that less than six actuators could be used to cause the grinding member to wobble as it is raised and lowered to grind material. It is also contemplated that more than six actuators may be used for certain milling operations.

Figure 5:
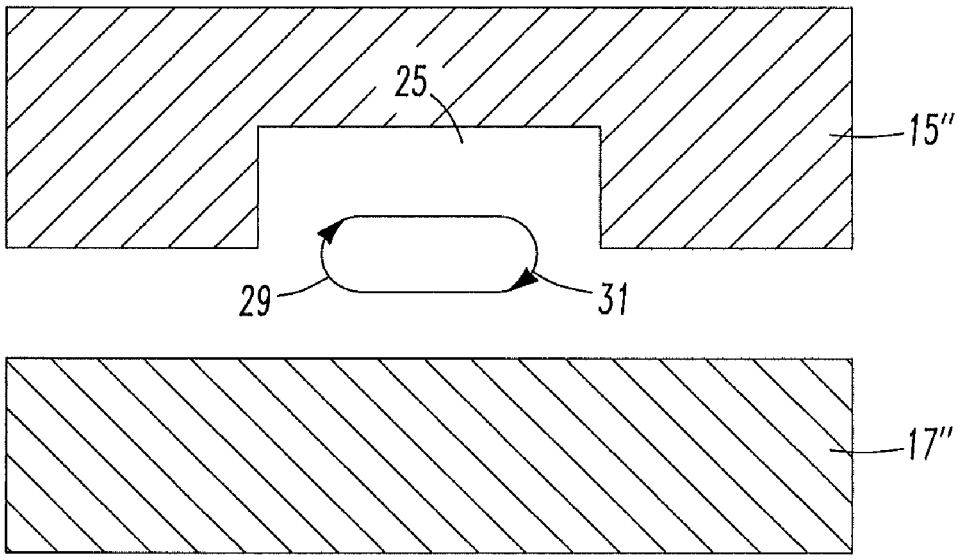
FIG. 5 is a fragmentary cross sectional view of a portion of a present preferred milling device illustrating a tread cut into the grinding member and the material movement that could be imparted during compressing and raising movement of the grinding member relative to the grinding surface of the table.
Figure 3A:
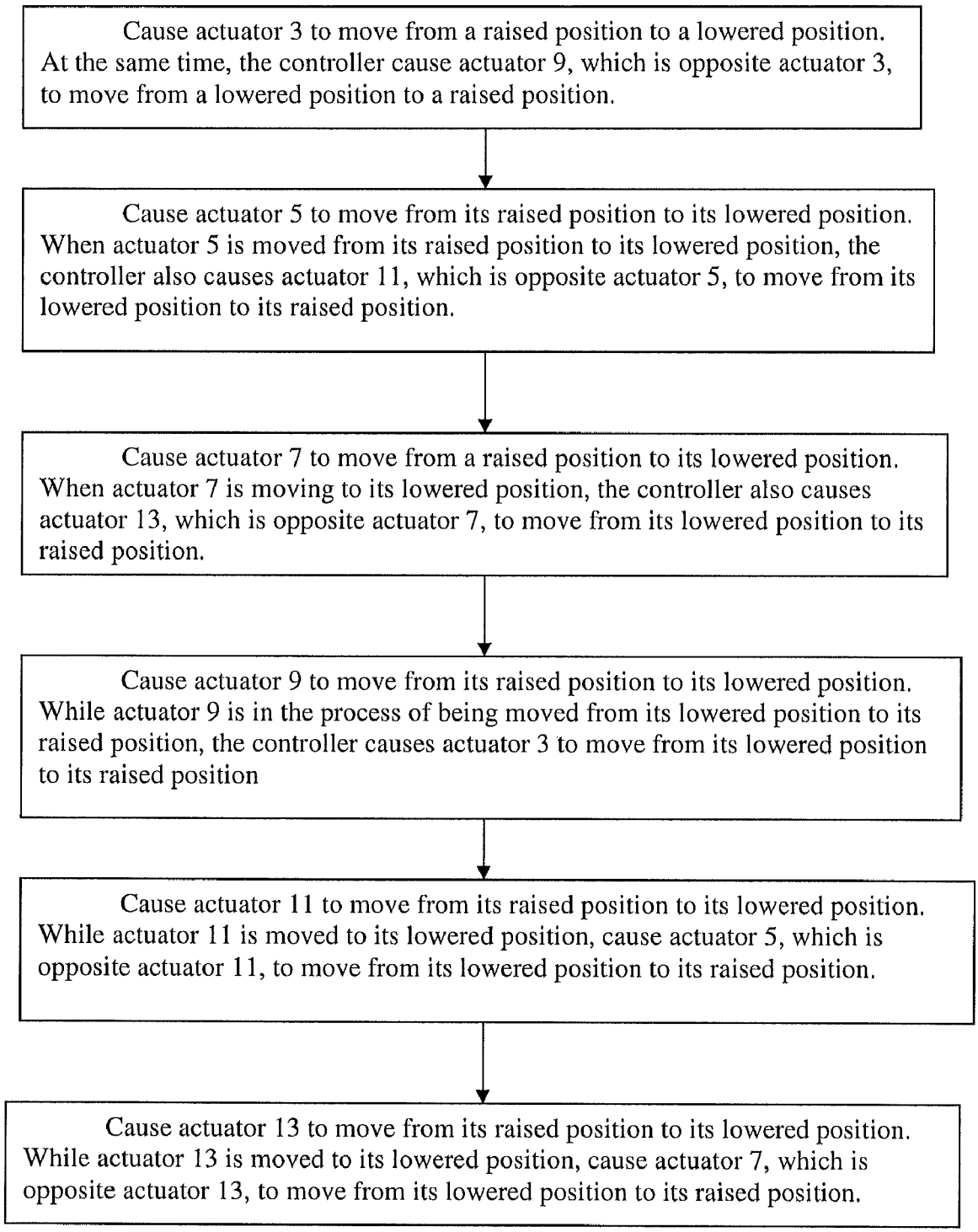
FIG. 3A is a flow chart illustrating a present preferred method of how a controller of the first present preferred embodiment of the milling device may cause the actuators to move to cause the grinding member to wobble as it is raised and lowered to grind material.

The grinding member 15" may include a treaded surface or have a wear surface as may be appreciated from FIG. 5. The tread 25 may be cuts, grooves, or other deformations formed in the grinding surface of the grinding member 15". The treads may be sized and configured to form an angular or spiral cut in the grinding member 15" to help push material towards the outside of the mill. It is also contemplated that the table 17" may also be configured to have such treads.

It is contemplated that different tread patterns and actuator stroke lengths can provide for different material flows or may permit the material flow to be adjusted. The longer the actuator stroke, the farther the grinding member opens relative to the table. The more the grinding member opens, the easier it is for material to move and, as a result, more material motion or an increased material flow can be created. It should be appreciated that this is particularly true for mills that are configured to be choke fed.

Referring to FIG. 5, raising of the grinding member 15" during milling operations can cause material to move in the direction shown by arrow 31 in FIG. 5. When the grinding member is being lowered to compress or grind material against the table 17", the motion can cause the material to move in the direction shown by arrow 29 in FIG. 5.

Treads formed in the wear surface of the grinding member 15" can also allow the grinding member to apply a greater pressure to material it impacts because the contact area between the grinding member and the table will be reduced. The treads can also be configured and sized to progressively prepare material for the next stage of grinding as the material moves toward the output opening of the mill or give material being ground room to expand while being milled. For example, the grinding member and table may define grinding surfaces in the grinding chamber that cause material being ground to experience an increased amount of compression force as the material moves toward the output opening.

It should be appreciated that because the actuators of the mill can be positioned adjacent to the outside of the mill, the actuators may be sized to be very large to deliver a greater total grinding force compared to a roller mill. Moreover, since the table or anvil portion of the mill may be designed to be stationary on the ground, there is no thrust pad limit from a reducer as is typical in roller mills. Further, the positioning of the actuators outside of the grinding surfaces can provide an improved mechanical advantage.

Mill vibration can be a problem for roller mills. Smaller material can fall through a material bed and then ramp up over material causing an up and down motion to a roller and unwanted vibration. The wobbling action of the mill 1 that may be caused by the actuators can provide a smooth approach to the material being ground because the contact patch is larger and grinding member movement occurs in a smooth motion that reduces the possibility of the grinding member sinking through the material. This can significantly reduce vibration caused by the material bed within a grinding chamber. This effect can also be beneficial to grinding ignitable fuels such as coal because the smooth wobbling movement of the grinding member would lend itself for more stable grinding relative to a bouncing roller of a roller mill.

Figure 6:
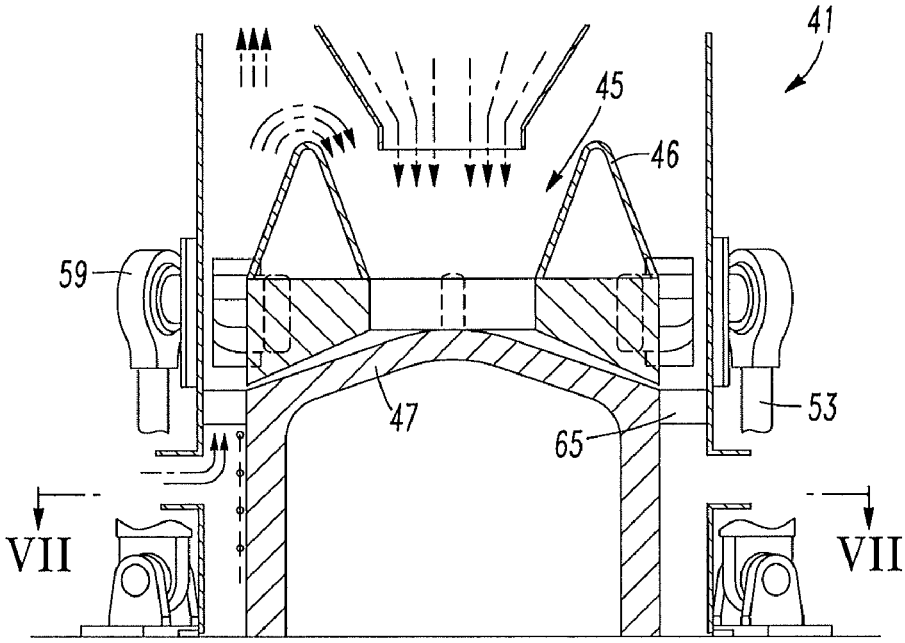
FIG. 6 is a cross sectional view similar to FIGS. 2 and 4 of a third present preferred embodiment of the milling device.
Figure 7:
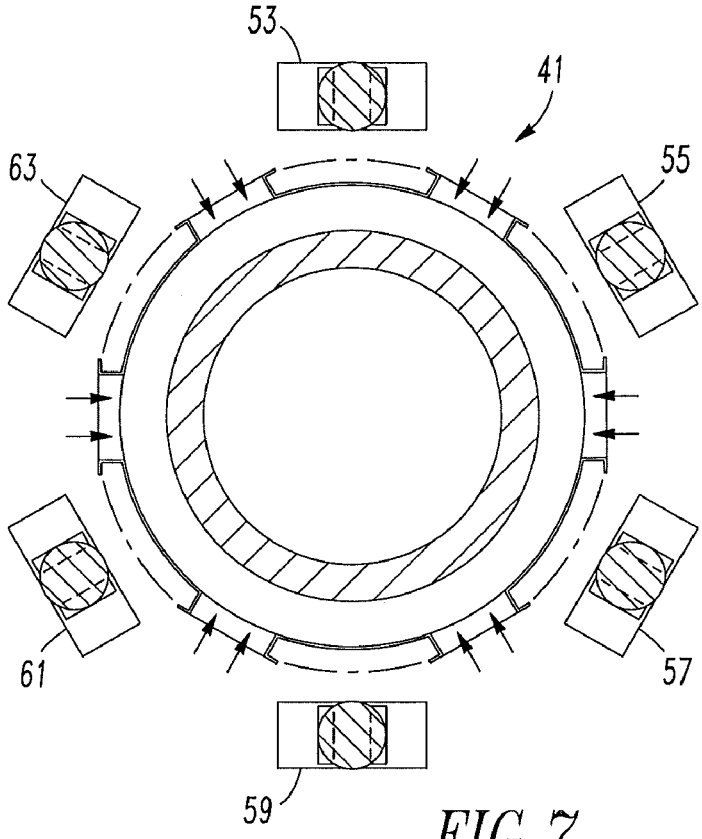
FIG. 7 is a cross sectional view of the third present preferred embodiment of the milling device taken along line VII-VII in FIG. 6.

Referring to FIGS. 6 and 7, another embodiment of the milling device 41 may be configured to use a conventional roller mill type air flow system. The mill 41 includes actuators such as actuators 53, 55, 57, 59, 61, and 63 that are attached to a grinding member 45 to move the grinding member relative to an anvil, or table 47. Preferably, the actuators are configured to move the grinding member so that the grinding member wobbles in a generally circular or elliptical grinding motion when the grinding member is raised and lowered to mill material.

Airflow may be introduced below the table 47 or grinding member 45. The air may flow through one or more nozzle rings 65 that are positioned to direct or adjust the velocity of the air so that material ground to a desired size is flowed upwards towards a classifier or separator (not shown) located above the milling device 41. Material that is not sufficiently ground may be pushed by the air flow to an opening between the classifier to be redirected back to the milling device for further grinding. Material that is too large to be effectively pushed by the air flow may fall to a reject collector to be fed back into the mill as well. The grinding member 45 may be sized and configured such that an upper portion of the grinding member 45 has a cone-like shape or an inverted opening to permit material that is not small enough to be pushed up to the classifier to be fed back into the grinding chamber of the milling device and serve as a catch for material rejected by a separator or classifier of a grinding circuit. It should be appreciated that such an opening that is defined by the upper portion of the grinding member 45 may facilitate choke feeding of material.

Figure 8:
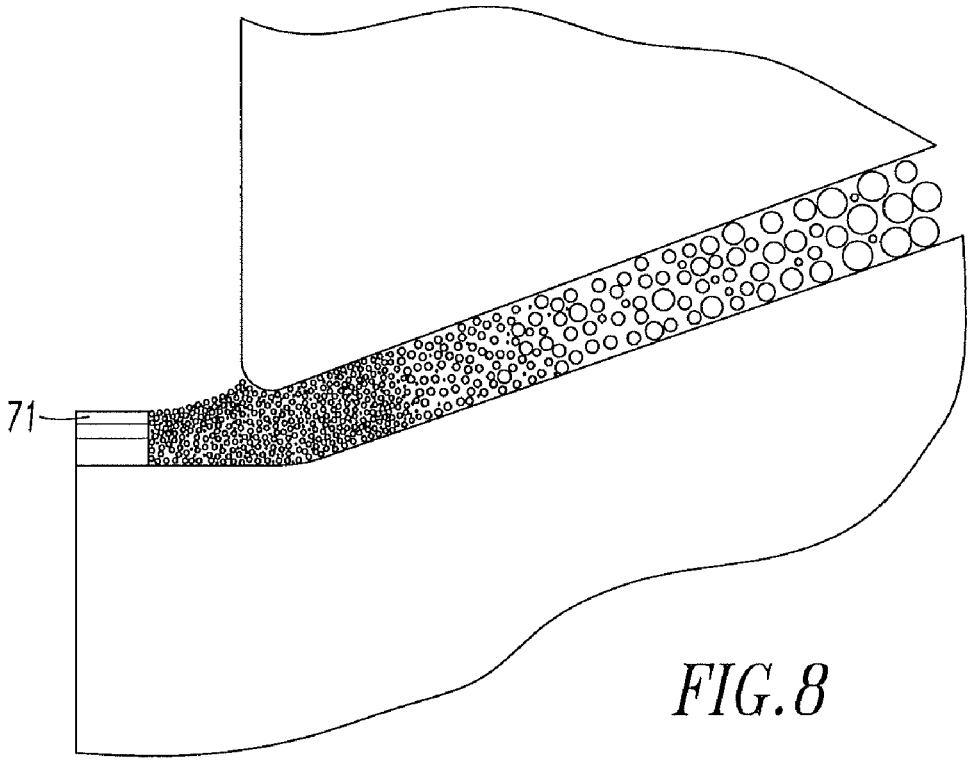
FIG. 8 is a fragmentary cross sectional view of a present preferred milling device that illustrates the use of a first present preferred dam ring.
Figure 9:
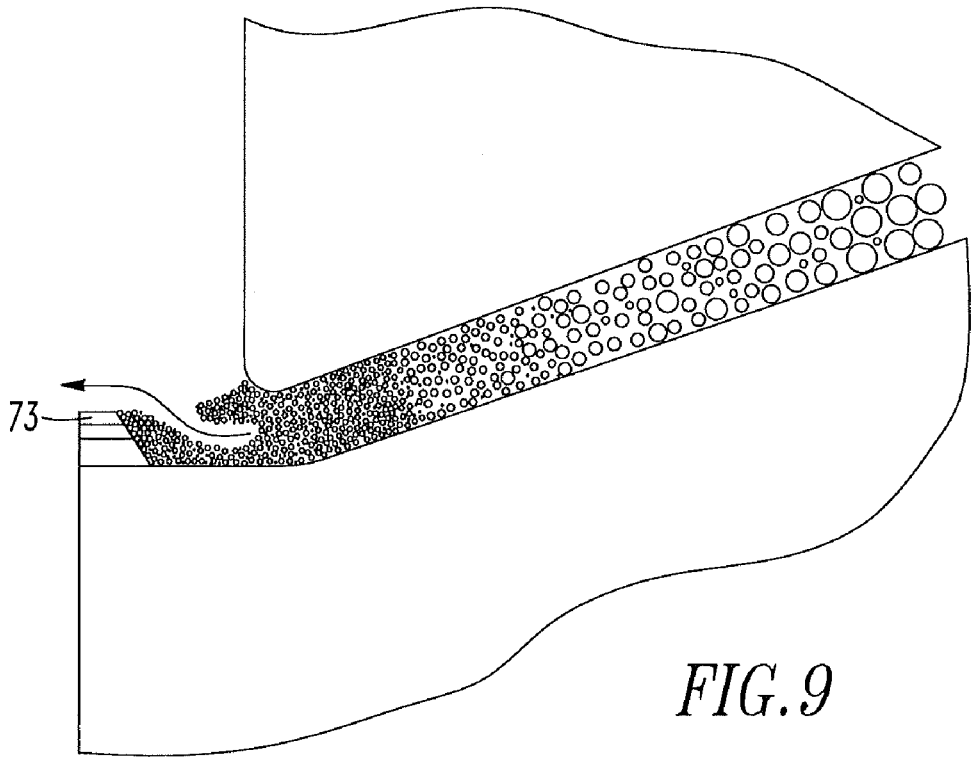
FIG. 9 is a fragmentary cross sectional view similar to FIG. 8 of a present preferred milling device that illustrates the use of a second present preferred dam ring.

As may be appreciated from FIGS. 8 and 9, it is also contemplated that a dam ring or ramped dam ring may be provided adjacent to the output opening or output openings of the mill to help hold material in place, but also allow material to be pushed outward. FIG. 8 illustrates a dam ring 71 that may be used adjacent to an output opening of a mill. FIG. 9 illustrates a sloped or ramped dam ring 73 that may alternatively be used adjacent to the output opening of the mill.

The grinding member may include shapes formed in the wear surface of the grinding member 75 to change or define a particular grinding chamber shape. The table may also have grooves, recesses, protrusions, projections or have a particular surface design formed therein to shape or define the grinding chamber. The contour formed by the grinding member and table surfaces that define the grinding chamber may be utilized to create a desired material flow rate or a desired milling operational capacity or characteristic. For instance, steeper angles of inclination of the table's grinding surface or a particular tread pattern formed in the table's grinding surface may aid material flow through the mill. Grinding member shapes or surface arrangements can also be provided to offer better retention of material being milled or a finer ground product.

It is also contemplated that grinding members may be composed of a base portion and a liner. Such a grinding member could then include a base portion configured to receive different liners. Those different liners could be provided for the grinding member wear surface of each grinding member to allow the manufacture of different types of material that utilize a similar grinding member shape to reduce the costs of making such grinding members while offering multiple different variations of grinding members that can be used to meet a particular milling need. It is also contemplated that the tables may be formed from a base portion and a liner that is attached to the base portion to define the grinding surface of the table.

Figure 10:
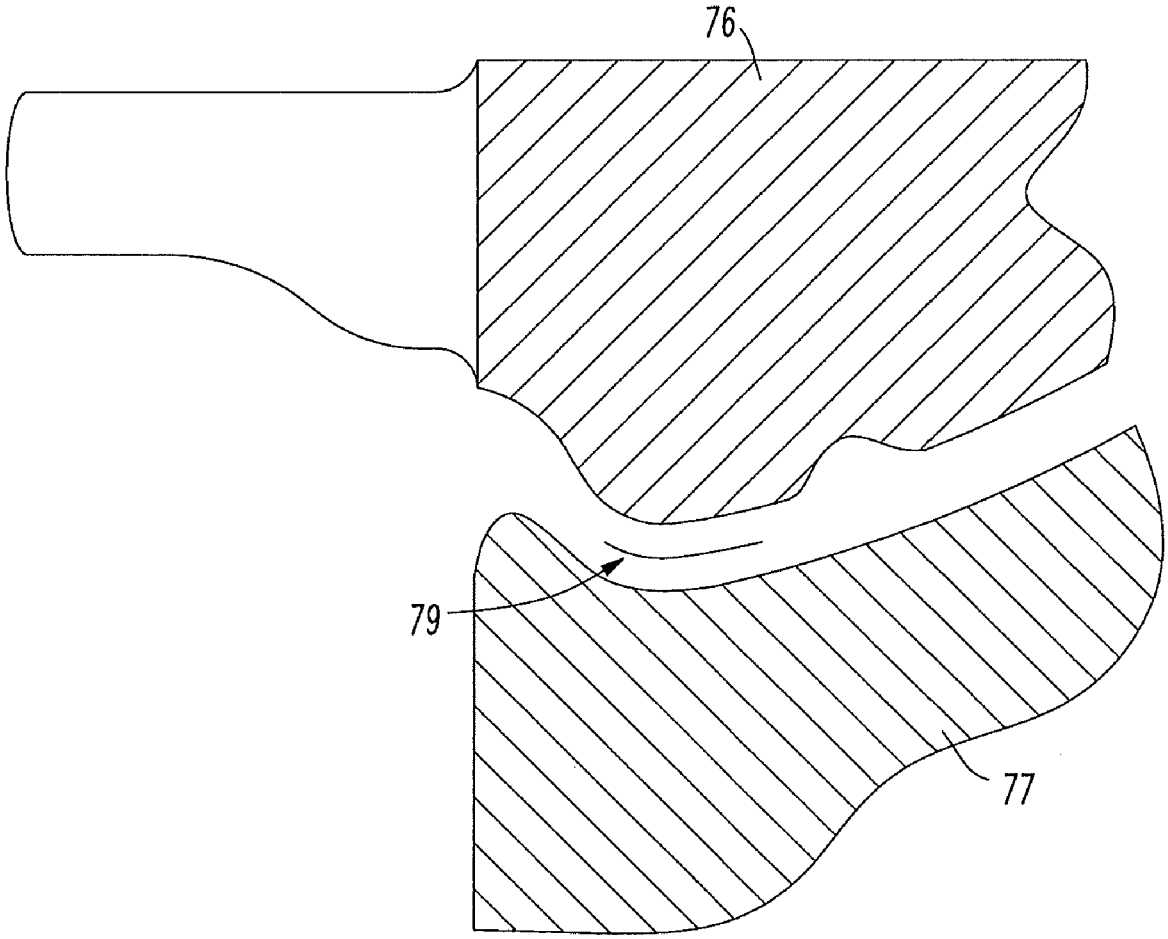
FIG. 10 is a fragmentary cross sectional view of a present preferred milling device illustrating a present preferred grinding chamber shape.

As may be appreciated from FIG. 10, a portion of the table 77 of a milling device may have a sloped dam ring integrally formed in the table adjacent to the output area of the milling device. The grinding member 76 may include grooves or channels or treading formed adjacent that dam ring portion of the table as well. The curved grinding member and table design can provide a zone of increased pressure 79 in the grinding chamber adjacent the output area of the milling device. Other contemplated grinding member and table size and shape configurations that may be utilized in variations of the milling device are shown in FIGS. 13-16. For example, the table and grinding member arrangement shown in FIG. 13 may provide multiple portions of a grinding chamber that have different generally linear portions that are arranged at different angles of inclination or slopes, such as angle of inclinations X° and Y°, to adjust material flow through those portions. In contrast, the arrangement shown in FIG. 14 can provide a grinding chamber that has a curved slope toward the output area of the milling device.

Other contemplated alternatives provide particular tread or groove configurations. For example, the arrangement shown in FIG. 15 can provide a channel 81 that is angled to aid with material advancement or retention. Such a channel 81 may effectively prepare material or increase the pressure experienced by material adjacent to the portion of the grinding chamber by the channel 81. As another example, the grinding member and table may be sized and configured to provide an inverted dome type material flow that includes a steeper angle as the material flows out of the mill to promote material flow. This may be particularly useful for sticky, wet, or viscous materials being milled. The grinding member may also include expansion gaps 85 that are formed in the grinding surface of the grinding member as well.

Figure 11:
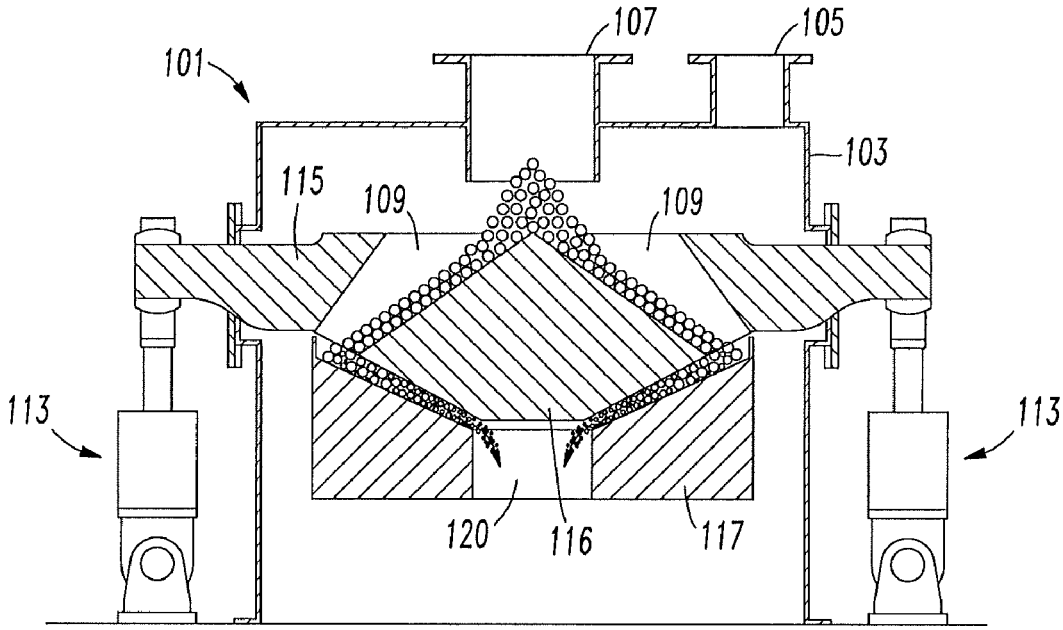
FIG. 11 is a cross sectional view similar to FIGS. 2, 4 and 6 of a fourth present preferred embodiment of the milling device.

It is also contemplated that embodiments of the milling device may be configured to provide an inverted material flow through the milling device without the use of an air flow as used in the milling device 41 shown in FIGS. 6 and 7. For example, a mill 101 may be configured to permit material to be milled and then discharged through an output opening located near the middle of the mill as shown in FIG. 11. Mill 101 includes a housing 103 that has a receptacle 107 configured to receive material for milling and a vent 105 configured for fugitive dust control. A plurality of actuators 113 may be connected to a grinding member 115. The grinding member has an opening 109 formed therein sized and configured to receive material fed through the receptacle 107. The opening 109 in the grinding member 115 permits material to pass through to a grinding chamber. A milling portion 116 of the grinding member 115 has a milling surface that defines the grinding chamber with a grinding surface of a stationary table 117. The table 117 defines an output opening 120 in the middle of the table 117. The actuators are connected to the grinding member 115 to cause the grinding member to wobble as it is raised and lowered to grind the material. The wobbling movement of the grinding member 115 is designed to cause the material to flow from the outside of the grinding chamber to the inside of the grinding chamber towards the output opening 120.

The milling portion 116 of the grinding member 115 is sized and configured to grind material against the table 117 via the wobbling movement. After the material is milled to a predetermined size range, the material passes through opening 120 to be fed to a classifier or separator for further processing. Alternatively, material may be passed through the opening 120 to be fed to a storage area until that material is needed.

Figure 12:
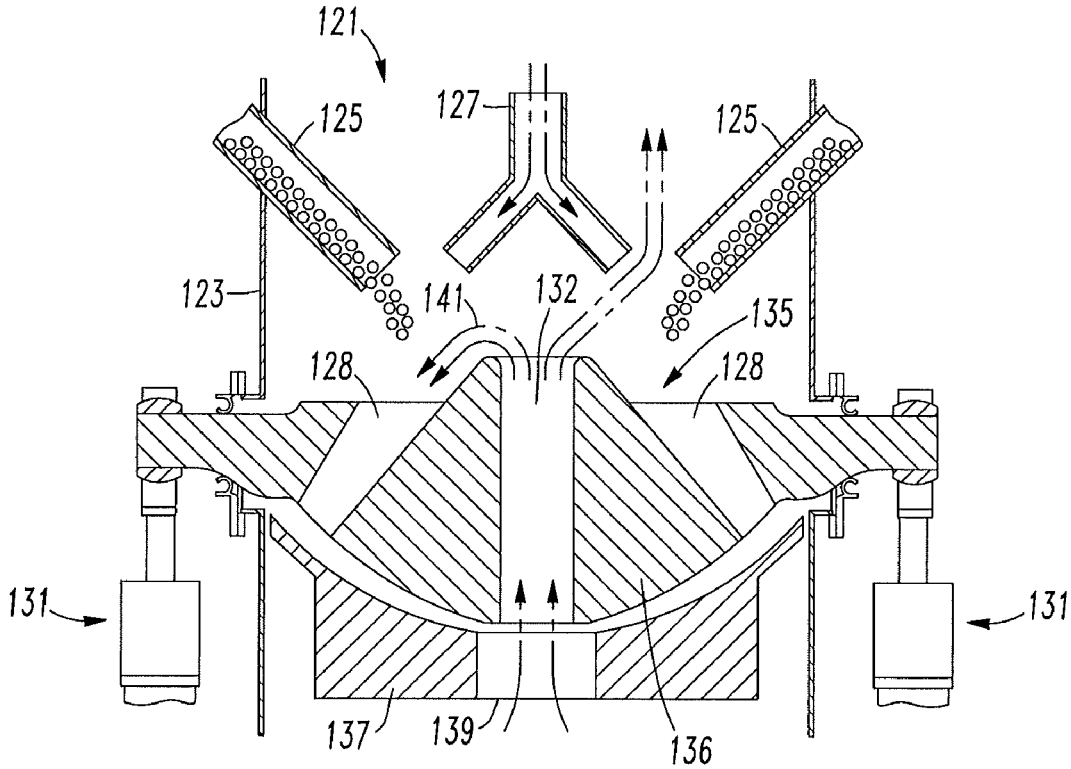
FIG. 12 is a cross sectional view similar to FIGS. 2, 4, 6 and 11 of a fifth present preferred embodiment of the milling device.
Figure 13:
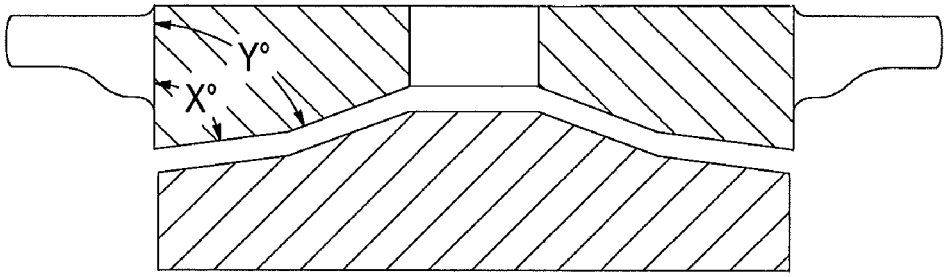
FIG. 13 is a cross sectional view of a first present preferred grinding chamber configuration that may be used in embodiments of the milling device.
Figure 14:
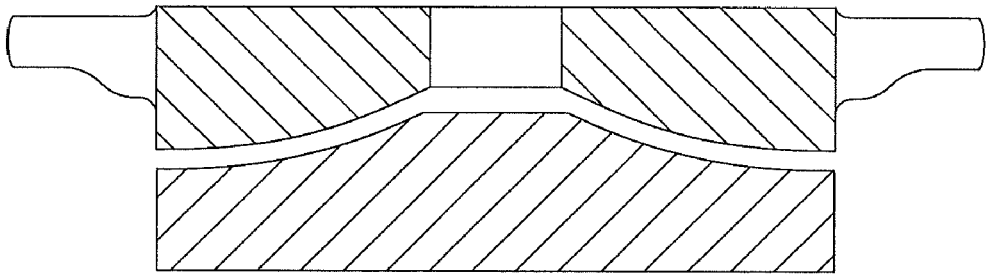
FIG. 14 is a cross sectional view of a second present preferred grinding chamber configuration that may be used in embodiments of the milling device.
Figure 15:
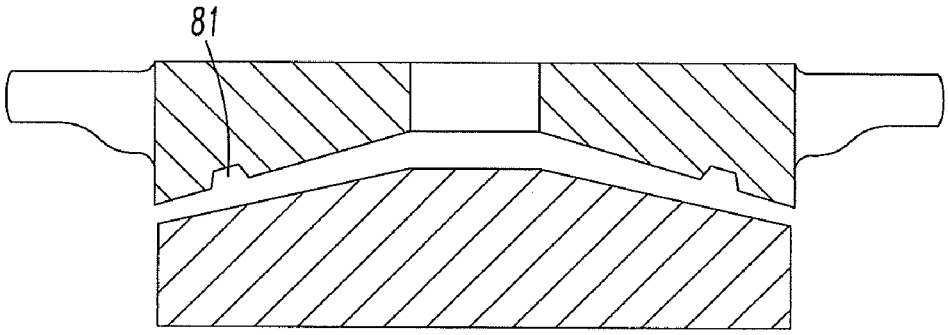
FIG. 15 is a cross sectional view of a third present preferred grinding chamber configuration that may be used in embodiments of the milling device.
Figure 16:
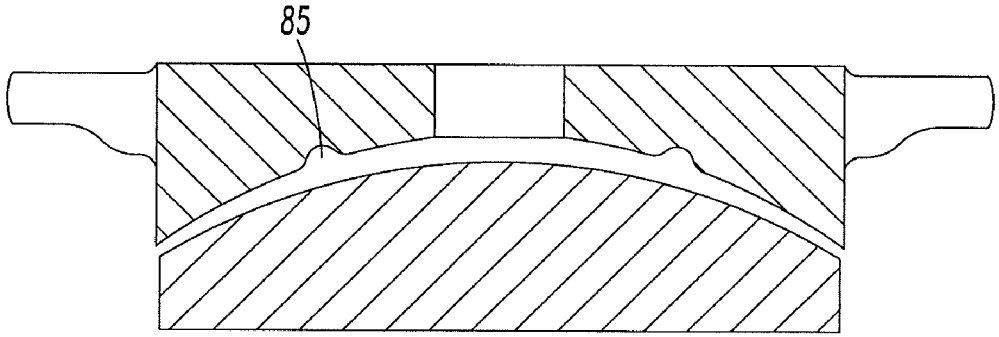
FIG. 16 is a cross sectional view of a fourth present preferred grinding chamber configuration that may be used in embodiments of the milling device.

Another design for a milling device that could be designed to mill material such that the output of the milling device is passed through an interior output opening is shown in FIG. 12. Mill 121 has a housing that includes a feed opening 125. The mill 121 may also have a material recycle opening 127 that is configured to receive material that was previously ground by the mill 121 but was larger than a predetermined size range. That material may be fed to the recycle opening 127 by a classifier or separator that receives output material from the mill 121 or another mill or grinding mechanism.

The mill 121 has a grinding member 135 that is connected to a plurality of actuators 131. The actuators are connected to the grinding member 135 so that the actuators can raise and lower the grinding member such that the grinding member 135 wobbles in a circular or elliptical sequence as it is raised and lowered. The grinding member 135 includes an opening 128 sized and configured to receive material from the feed opening 125 and the recycle opening 127. The grinding member 135 may also have an output opening 132 that is adjacent to and interior of the opening 128.

The mill may be sized and configured so that material fed into the mill for grinding passes through the opening 128 to a grinding chamber defined by a grinding portion 136 of the grinding member 135 and a table 137 positioned below the grinding portion 136 of the grinding member 135. The table 137 may have a hole or output opening 139 located in a middle portion of the table 137. The grinding portion 136 of the grinding member may be positioned between the opening 128 and output opening 132 formed in the grinding member 135.

Air may be passed through the opening 139 in the table 137 at a flow rate that is sufficient to lift material that has been milled to a predetermined size through opening 139 and opening 132 and out of an output aperture (not shown) located above the grinding member 135 or a classifier or separator (not shown). It should be understood that the rate of the air flow passing through openings 139 and 132 is dependent upon the predetermined acceptable milled size of the material and the dimensions of the openings, and mill components. Material that is too large to be sufficiently lifted by the air flow may pass out of the output opening 132 in the grinding member 135 and back through opening 128 in the grinding member as shown by arrows 141 in FIG. 12. Material that is too large to be lifted by the air flow may be collected by a collection device and reintroduced into feed chutes 125 for further milling.

It should be understood that embodiments of the milling device may include dust seals or sealing mechanisms. Such seals or sealing mechanisms may be used to ensure that material ground by the milling device does not pose a work hazard to personnel working near the milling device or to ensure that air pressure is maintained at a desired pressure to ensure air flows move at a desired flow rate.

Designs of the milling devices discussed above and shown in the Figures provide milling devices that utilize much simpler designs than the designs of roller mills. For example, mill stands, pressure levers, rollers, bearings, circulatory lubrication units, axles and gear reducers common in roller mills are not needed in the mill designs discussed above. At least in part due to the milling device design of the milling devices discussed above requiring less complicated components, the costs, lead times and fabrication of such mills are much lower relative to roller mills. Further, the milling device designs discussed above may provide customizable grinding mechanics such as compression and shear pressures. Material retention within the milling devices may also be adjusted to meet different needs.

It should be appreciated that other variations of the present preferred embodiments of the milling devices discussed above may be made. For instance, it should be appreciated that there may be other variations of grinding member and table arrangement that may be used to define a grinding chamber of a milling device. As another example, the size of the milling device and the number of actuators used to raise and lower the grinding member of the milling device and cause the grinding member of the milling device to wobble as it is raised and lowered may be different to meet different design objects. As yet another example, the composition of the material used to form the grinding member and table components may be different to meet a particular design goal.

While certain present preferred embodiments of milling devices and methods of making and using the same have been shown and described above, it is to be distinctly understood that the invention is not limited thereto but may be otherwise variously embodied and practiced within the scope of the following claims.

What is claimed is:

1. A milling device comprising:

a grinding member;

a table having a grinding surface, the table positioned adjacent to the grinding member such that the grinding surface faces toward at least a portion of the grinding member;

the table and the grinding member at least partially defining a grinding chamber sized and configured to receive material;

a plurality of actuators, each actuator connected to the grinding member such that movement of that actuator causes at least a portion of the grinding member to move from a raised position to a lowered position to grind the material; and a controller connected to the actuators, the controller configured to cause the actuators to move in a sequence that causes the grinding member to wobble as the grinding member is moved by the actuators to grind the material.

2. The milling device of claim 1 wherein each actuator is a fluid cylinder, a hydraulic cylinder, a gas cylinder, an electric linear actuator, a lever action actuator or a linear moving actuator.

3. The milling device of claim 1 wherein the controller is configured to cause the grinding member to wobble at least one of a clockwise direction and a counterclockwise direction.

4. The milling device of claim 1 wherein the grinding member has a milling portion, the milling portion defining a milling surface, the milling surface having at least one tread or at least one projection.

5. The milling device of claim 1 wherein at least one of the table and the grinding member has at least one tread formed therein, the at least one tread partially defining the grinding chamber.

6. The milling device of claim 1 wherein the grinding member and table at least partially define an output opening sized and configured to receive ground material, the milling device also comprising a dam ring or a ramped dam ring adjacent to the output opening.

7. The milling device of claim 1 wherein the grinding chamber is sized configured to cause material that is being ground to move downward toward an output opening.

8. The milling device of claim 7 wherein the grinding chamber is also sized and configured to cause material that is ground to move in an outward direction or an inward direction.

9. The milling device of claim 1 wherein the table has an opening.

10. The milling device of claim 9 wherein the grinding member has a first opening, the first opening of grinding member being aligned with the opening of the table.

11. The milling device of claim 10 wherein the grinding member has a second opening, the second opening sized and configured to receive material and guide the material to the grinding chamber.

12. The milling device of claim 10 further comprising a housing that at least partially encloses the grinding member and the table, the housing having an output opening sized and configured to permit material that has been ground by the milling device to pass therethrough, the first opening of the grinding member and the opening of the table being sized and configured to receive an air flow that is directed through the first opening of the grinding member and the opening of the table to push material that has been ground out of the grinding chamber and toward the output opening.

13. The milling device of claim 1 wherein the grinding member has a channel formed therein and the table and the grinding member define an output opening, the channel of the grinding member being positioned adjacent to the output opening.

14. The milling device of claim 1 further comprising a housing that at least partially encloses the grinding member and the table, the housing having an output opening; and at least one nozzle ring positioned adjacent to at least one of the table and the grinding member, the nozzle ring configured to allow air to pass therethrough to cause material exiting the grinding chamber that is ground to a predetermined size to be pushed toward the output opening.

15. The milling device of claim 1 wherein the grinding member has at least one opening sized and configured to receive material and guide the material to the grinding chamber.

16. The milling device of claim 1 wherein each actuator is configured to move from a raised position to a lower position along a linear path or a substantially linear path and wherein the grinding surface of the table is stationary.

17. The milling device of claim 1 wherein the grinding chamber has a first portion that has a first angle of inclination and a second portion adjacent to the first portion, the second portion having a second angle of inclination that is different than the first angle of inclination.

18. The milling device of claim 1 wherein the first angle of inclination is less than the second angle of inclination or the first angle of inclination is greater than the second angle of inclination.

19. The milling device of claim 1 wherein the controller is configured to cause the grinding member to wobble in a first direction for a first predetermined amount of time and then wobble in a second direction that is opposite the first direction for a second predetermined amount of time.

20. The milling device of claim 1 wherein each actuator is positioned at an inward lean position or an outward lean position.

21. The milling device of claim 1 wherein the grinding member is comprised of a base portion and a milling portion, the milling portion being composed of a liner attached to the base portion.

22. The milling device of claim 1 wherein the table is comprised of a base portion and a liner attached to the base portion of the table, the liner of the table at least partially defining the grinding surface.

23. The milling device of claim 1 wherein an upper portion of the grinding member is sized and configured to define an opening sized and configured to collect material and retain the material for choke feeding.

24. The milling device of claim 1 further comprising a plurality of bearings, each bearing connecting a respective actuator to the grinding member.

25. The milling device of claim 1 further comprising a plurality of bearings that at least partially form connections between the actuators and the grinding member.

* * * * *